United States Patent [19]

Morohoshi

[11] Patent Number: 4,902,568

[45] Date of Patent: Feb. 20, 1990

[54] RECORDING MEDIUM AND RECORDING METHOD BY USE THEREOF

[75] Inventor: Naoya Morohoshi, Hiratsuka, Japan

[73] Assignee: Canon Kabushiki Kaisha, Tokyo, Japan

[21] Appl. No.: 8,915

[22] Filed: Jan. 30, 1987

[30] Foreign Application Priority Data

| | | | |
|---|---|---|---|
| Feb. 7, 1986 | [JP] | Japan | 61-026462 |
| May 23, 1986 | [JP] | Japan | 61-119440 |
| Jul. 4, 1986 | [JP] | Japan | 61-158177 |

[51] Int. Cl.[4] ..... B41M 5/00

[52] U.S. Cl. ..... 428/331; 346/135.1; 428/195; 428/211; 428/446; 428/447; 428/514; 428/522; 428/537.5

[58] Field of Search ..... 346/1.1, 135.1; 428/195, 211, 537.5, 323, 281, 283, 331, 446, 447, 514, 522; 427/261, 288

[56] References Cited

U.S. PATENT DOCUMENTS

| | | | |
|---|---|---|---|
| 4,165,399 | 8/1979 | Germonprez . | |
| 4,361,843 | 11/1982 | Cooke . | |
| 4,375,494 | 3/1983 | Stokes | 428/323 |
| 4,381,946 | 5/1983 | Uehara . | |
| 4,400,637 | 7/1984 | Miyamoto et al. | 428/216 |
| 4,440,827 | 4/1984 | Miyamoto et al. | 428/327 |
| 4,474,847 | 10/1984 | Schröder et al. | 428/331 |
| 4,478,910 | 10/1984 | Oshima et al. | 428/331 |
| 4,508,510 | 4/1985 | Fujii . | |
| 4,620,876 | 11/1986 | Fujii . | |
| 4,636,409 | 1/1987 | Arai . | |
| 4,686,138 | 8/1987 | Toyama et al. | 428/323 |
| 4,780,356 | 10/1988 | Otowma et al. | 428/206 |

FOREIGN PATENT DOCUMENTS

| | | | |
|---|---|---|---|
| 0121916 | 10/1984 | European Pat. Off. | 428/195 |
| 0275711A1 | 7/1988 | European Pat. Off. | 428/331 |
| 898614 | 6/1962 | United Kingdom | 428/195 |
| 1093041 | 11/1967 | United Kingdom | 428/195 |
| 1390137 | 4/1975 | United Kingdom | 428/195 |
| 2148147A | 5/1985 | United Kingdom | 428/195 |
| 2159767A | 12/1985 | United Kingdom | 428/195 |

OTHER PUBLICATIONS

Chem Abs vol. 104, No. 6 44893 "Fine spherical silica as magnetic tape filler" Denki Kagaku Kogyo JP Patent No. 85108313 (60108313).

Chem Abs vol. 67, No. 2 3951 "Preparation of pigment fillers and their use in paper" Societe, Francaise des Silicates Speciaux Sifrance Neth Appln No. 6509993.

*Primary Examiner*—Pamela Schwartz

*Attorney, Agent, or Firm*—Fitzpatrick, Cella, Harper & Scinto

[57] ABSTRACT

There are disclosed a recording medium which comprising spherical silica contained in the surface to be recorded or in the inside thereof.

18 Claims, No Drawings

RECORDING MEDIUM AND RECORDING METHOD BY USE THEREOF

BACKGROUND OF THE INVENTION

1. Field of the Invention

This invention relates to a recording medium and a recording method, more particularly to an improved recording medium which can provide various characteristics such as excellent color forming characteristic, ink dot shape, etc., and an ink jet recording method by use of said recording medium.

2. Related Background Art

Ink jet recording performs by generating small droplets of recording liquid (hereinafter called ink) using discharging systems (e.g. electrostatic attraction system, the system of giving mechanical vibration or displacement to ink by use of a piezoelectric element, the system in which pressure formed when ink is foamed by heating), permitting them to fly and attaching a part or whole thereof onto a recording medium such as paper. This method is now attracting attention as a recording method which minimizes generation of noise and is capable of performing high speed and multicolor printing.

As an ink for ink jet recording, there have been primarily used an aqueous type ink for the reasons of safety and recording characteristics, while as a recording medium, normal paper has been generally used in the prior art. When performing recording on such paper with a liquid ink, it is generally required that printed letters should not become unclear by blurring, and it is also desirable that the ink after recording should be dried as soon as possible to avoid unexpected contamination of the paper surface.

Particularly, in the multi-color ink jet recording system which use inks of two or more different colors, various requirements as set forth below should be satisfied.

(1) Even if a first ink is absorbed rapidly onto a recording medium, an ink attached later should not be mixed with the ink previously attached, or should not disturb the ink dot or should not flow out.

(2) The diameter of the ink dot may not become greater than required due to diffusion on a recording medium.

(3) The shape of an ink dot should be approximate to a true circle, and its circumference should be smooth.

(4) The density of an ink dot should be high, enough to retain its clear circumference.

(5) The whiteness of a recording medium should be high enough to give good contrast of an ink dot as formed.

(6) The color of an ink should not be affected by a recording medium.

(7) The dimensional fluctuation of a recording medium (e.g. wrinkle, elongation) should be minimal before and after recording.

(8) The recorded image should have sufficient resistance to water, oxidative gas in the air and light.

(9) Power dropping off from the coated layer of a recording medium or a substrate should be kept minimum, etc.

In order to satisfy these requirements, there have been made several proposals in the prior art. For example, for improvement of ink absorptivity or blurring of ink dots, Japanese Laid-Open patent application No. 49113/1978 discloses an ink jet recording paper comprising a sheet made of wood pulp impregnated with a water-soluble polymer. As examples of coated paper, Japanese Laid-open patent application No. 5830/1980 discloses an ink jet recording sheet having an ink absorptive coated layer provided on a support, and Japanese Laid-open patent application No. 11829/1980 an ink jet recording sheet comprising two or more layers with different ink absorptivities on paper which is not sized, respectively. Further, the ink jet recording medium disclosed in Japanese Laid-Open patent application No. 99693/1981 obtains water resistance by containing a quaternary ammonium halide, etc.

Also, there is proposed a paper containing synthetic amorphous silica as an ink jet recording medium. This recording medium, while having the advantage of, e.g., excellent color forming characteristic of a recording agent as an ink jet recording medium, has non-uniform shapes of such silica particles and wide distribution of particle sizes thereof, and therefore involves the inconvenience that, when ink absorptivity is intended to be improved, the coated layer strength is lowered to generate powder drop-off. Particularly, powder drop-off from the coated layer of the recording medium or the substrate causes non-discharging of ink through clogging of nozzles, whereby reliability of a recording device will be undesirably lowered.

Also, Japanese Laid-open patent application No. 146889/1984 discloses a non-coated type of ink jet recording paper in which synthetic amorphous silica is internally added as the loading material.

Such recording paper, while having the advantages of, e.g., improvement of dot shape as well as optical density as compared with recording papers containing loading materials generally employed such as clay, talc, calcium carbonate, etc., does not have satisfactory characteristics for uses in which high image quality is demanded.

Accordingly, an object of the present invention is to satisfy the various tasks which could not be solved by the prior art in the field of art as described above, particularly to provide a recording medium which can satisfy various demands as mentioned above, particularly which can improve color forming characteristic, optical density and dot shape in recording of color images by use of a plural number of color inks according to the ink jet recording system and an ink jet recording method by use thereof.

Another object of the present invention is to provide a recording medium which can satisfy, at the same time, the requirements for color forming characteristic, ink absorptivity and coated layer strength.

SUMMARY OF THE INVENTION

In one aspect, the present invention provides a recording medium, comprising spherical silica contained in the surface to be recorded or in the inside thereof.

In another aspect, the present invention provides a recording medium comprising a fibrous material and a loading material, wherein said loading material is spherical silica, and said silica is intermixed in said fibrous material.

In further aspect, the present invention provides a recording medium comprising a substrate and an ink receiving layer provided on said substrate, wherein said ink receiving layer contains spherical silica.

In still another aspect, the present invention provides an ink jet recording method, which comprises performing recording on a recording medium containing spherical silica in the surface to be recorded or in the inside thereof with the use of an ink having a surface tension of 28 to 68 dyn/cm.

DETAILED DESCRIPTION OF THE PREFERRED EMBODIMENTS

Describing in detail about the present invention, the present inventor has found that, in recording on various recording media with an ink using a water-soluble dye as the recording agent, by incorporating spherical silica in the above recording media, the image formed with such ink can be improved in color forming characteristic, optical density and dot shape, and particularly that, in the papers for ink jet recording of the general paper type which could be made in the related art with excellent feel, resistance to powder drop-off and at low cost, but could be improved in optical density and dot shape with difficulty, the above-mentioned color formation density and the dot shape were remarkably improved, based on which the objects of the present invention have been accomplished.

Describing the recording medium which primarily characterizes the present invention, the feature of the recording medium of the present invention which is a sheet containing a fibrous material and a loading material resides in comprising spherical silica intermixed in said sheet, and the objects of the present invention could be accomplished by such a constitution and the constitution of ink as described below.

The fibrous material to be used in the present invention may be generally a wood pulp, typically LBKP and NBKP, and may be also mixed with various synthetic fibers, glass fibers, etc., if desired.

The loading material to be used in the present invention may be the spherical silica alone as described hereinafter. It is also possible to use, in combination with such spherical silica, inorganic pigments such as talc, clay, kaolin, diatomeceous earth, calcium carbonate, calcium sulfate, barium sulfate, titanium oxide, zinc oxide, zinc carbonate, aluminum silicate, calcium silicate, magnesium silicate, aluminum hydroxide, aluminum oxide, synthetic amorphous silica, colloidal silica, etc., and/or organic pigments such as urea resin pigments, plastic pigments, etc., if desired.

As the spherical silica to be used in the present invention, synthetic spherical silica having inner surface area can be used. The spherical shape as mentioned in the present invention means that the ratio of the shortest diameter to the longest diameter in the same secondary particles is 0.6 or more, particularly preferably 0.8 or more.

The spherical silica to be used in the present invention can be prepared by, for example, forming silica gel and porous silica in the form of spherical shapes as described below.

Silica gel is a three-dimensionally polymerized product of high-reactive orthosilicic acid $Si(OH)_4$, and it may be structurally considered as a polymer of silicon dioxide $SiO_2.nH_2O$.

As a method for preparation of orthosilicic acid, there is the method in which silicon tetrachloride or sodium silicate is used. Also, silica gel can be produced by neutralizing alkaline content in water-glass (of which main components are $Na_2SiO_3$ and $Na_2Si_2O_5$) to effect gelation, followed by dehydration.

According to any method, the particle diameter and fine pore size of silica gel can be controlled by varying the concentration of orthosilicic acid, pH of the reaction mixture, solvent composition, stirring speed during polymerization reaction. The spherical silica gel can be produced according to a method in which the polymerized reaction mixture is dispersed into an oil layer to effect gelation, or a method in which the polymerized reaction mixture is sprayed into dry air to effect gelation, etc.

According to the above operations, only ordinary gel can be obtained. A porous silica can be prepared by effecting gelation with addition of a pore forming agent such as dextran, long chain fatty acid, soluble starch, MgO, etc., into the sodium silicate solution, and then removing such agents by extraction with solvent or hydrolysis.

As another method for preparation of porous silica, there is a method in which silica sol with a narrow particle size distribution is gelled.

Porous silica having various pore sizes can be prepared according to the methods as mentioned above.

In the present invention, for improvement of storability of the ink jet recorded image, etc., in any of the steps in the methods for preparation as described above, a metal such as Al, Mg, Zn, Ca, etc., may be also included in the form of a complex silicate, etc.

The spherical silica prepared according to the above preparation method is more smooth in shape of particles and also higher in uniformity of the particle size as compared with synthetic amorphous silica prepared by the processes of pulverization and classification. Accordingly, when the spherical silica is applied to a paper for ink jet recording, there is the advantage of reduced light scattering at an ink attached portion as well as improvement of optical density and dot shape of a recorded image through improvement of uniformity of capillary diameters. Further, due to the spherical shape, there is also the advantage of minimal wire abrasion of a paper machine.

The spherical silica to be used in the present invention should preferably have an average diameter of the secondary particles within the range of from 0.5 $\mu$m to 150 $\mu$m, particularly preferably from 1 $\mu$m to 30 $\mu$m, as measured by the Coulter method, which is a porous synthetic spherical silica with the particle proportion within the particle size range of average diameter $\pm 1.5$ $\mu$m being 60% or more, more preferably 80% or more (based on number of the particles). If the average diameter is greater than the above range, the image will become coarse due to lowered resolution and deterioration of the dot shape.

As the particle diameter is smaller, the number of the particles of spherical silica being present in the surface and in the inside of the recording paper is increased, whereby probability of ink droplets being in contact with and being absorbed by spherical silica particles becomes greater. Accordingly, with respect to the dot shape, the particle diameter should be preferably as small as possible, but in the case of a particle diameter smaller than 0.5 $\mu$m, above all when it is 0.2 to 0.4 $\mu$m, the scattering coefficient becomes greater to bring about an undesirably lowering in optical density.

Also, in the case of sheet formation of a recording medium with spherical silica internally added, too fine particles pose a problem in production that it is difficult to retain them within the wet web on the wire of a paper machine even when used with a yield enhancer, etc.

On the other hand, as to the average fine pore size (fine pore: voids between primary particles) in the inside of the spherical silica, there is an optimum range, and in the present invention, spherical silica with an average fine pore size within the range from 30 Å to 400 Åis preferred. As the fine pore size is greater, the fine pore volume in the inside of the secondary particles of the spherical silica becomes greater to make the ink absorbing capacity greater. However, when the fine pore size is greater than 400 Å, capillary condensation of the dye molecules near the surface layer of the secondary particles will occur with difficulty, whereby the optical density will be lowered. When the fine pore size is smaller than 30 Å, the ink absorbing capacity is undesirably small.

In the present invention, as the method for incorporating the above spherical silica and optionally other loading materials in the recording medium, there may be employed the so-called internal addition method in which the spherical silica is added to the slurry containing fibrous material in the paper making step, or the so-called after-treatment method in which it is impregnated or coated by means of a size press device or a spray device, etc., or alternatively both methods may be used in combination.

In the case of the internal addition method, paper strength enhancers, yield enhancers, colorant, etc., may be added if desired. As the yield enhancer, there may be employed cationic yield enhancers such as cationized starch, dicyandiamideformalin condensate, etc., or anionic yield enhancers such as anionic polyacrylamide, anionic colloidal silica, etc., either individually or in combination.

In the case of the after-treatment method, a surface treating agent such as modified starch or polyvinyl alcohol can be also used in combination with the spherical silica. Also, if desired, water resistance improvers of images, flowing property improvers, thickeners, pigment dispersing agents, foaming inhibitors, defoaming agents, foaming agents, penetrating agents, surfactants, colorants, fluorescent brightening agents, UV-ray absorbers, antioxidants, etc., can be also formulated.

The content of the spherical silica in the recording medium in the present invention should be preferably 3 wt. % to 30 wt. % as the ash content in the paper, more preferably 8 to 30 wt. %, particularly preferably 15 to 25 wt. %.

As another embodiment of the present invention, there is a recording medium, comprising at least an ink receiving layer provided on a substrate, said ink receiving layer containing spherical silica.

As the binder forming the ink-receiving layer, there may be included water-soluble polymers such as starch, gelatin, casein, gum arabic, sodium alginate, carboxymethyl cellulose, polyvinyl alcohol and derivatives thereof, polyvinylpyrrolidone, sodium polyacrylate, etc.; polymeric emulsions such as synthetic rubber latex, etc.; organic solvent soluble resins such as polyvinylbutyral, polyvinyl chloride, etc.

Among the water-soluble polymers, particularly preferable are silicon-containing water-soluble polymers, for example, silicon-containing modified polyvinyl alcohols, etc., and any of those as disclosed in Japanese Laid-open patent application No. 59203/1983, No. 79003/1983 and No. 164604/1983 can be preferably used.

Examples of the silicon-containing modified polyvinyl alcohol to be used in the present invention are shown below.

(1) A product obtained by copolymerizing a vinyl ester and an olefinic unsaturated monomer containing silicon in the molecule represented by the formula (A) in the presence of alcohol under the conditions where the concentration ratio of these two kinds of monomers is kept constant throughout the polymerization period and saponifying the copolymer obtained:

$$CH_2{=}CH{-}(CH_2)_n{-}\overset{\overset{\displaystyle R'_m}{|}}{Si}{-}(R^2)_{3-m} \qquad (A)$$

wherein n is 0 to 1, m is 0 to 2, $R^1$ is a lower alkyl group, an allyl group or a lower alkyl having an allyl group, $R^2$ is a saturated branched or non-branched alkoxyl group having 1 to 40 carbon atoms, and said alkoxyl group may also have a substituent containing oxygen;

(2) A product obtained by copolymerizing a vinyl ester and a silicon-containing polymerizable monomer represented by the formula (B) in the presence of alcohol by use of a radical polymerization initiator and saponifying the copolymer obtained;

$$CH_2{=}\underset{\underset{\displaystyle R^4}{|}}{\underset{|}{CR^3}}{-}CON{-}R^5{-}\overset{\overset{\displaystyle R_n^6}{|}}{Si}{-}(R^7)_{3-n} \qquad (B)$$

wherein, $R^3$ is hydrogen or a methyl group, $R^4$ is hydrogen or a lower alkyl group, $R^5$ is an alkylene group or a divalent organic residue of which chain carbon atoms are mutually bonded with oxygen or nitrogen, $R^6$ is hydrogen, halogen, a lower alkyl group, an allyl group or a lower alkyl group having an allyl group, $R^7$ is an alkoxyl group or an acyloxyl group where the alkoxyl group or the acyloxyl group may also have a substituent containing oxygen or nitrogen, n represents 0 to 2;

(3) A product obtained by copolymerizing a vinyl ester and a silicon-containing polymerizable polymer represented by the formula (C) in the presence of alcohol by use of a radial polymerization initiator and saponifying the copolymer obtained;

$$CH_2{=}\overset{\overset{\displaystyle R^8}{|}}{C}{-}\overset{\overset{\displaystyle R_n^9}{|}}{Si}.(\underset{\underset{\displaystyle O}{\|}}{OCR^{10}})_{3-n} \qquad (C)$$

wherein $R^8$ is a hydrogen atom or a methyl group, $R^9$ is a hydrogen atom, a halogen atom, a lower alkyl group, an allyl group or a lower alkyl group having allyl group, $R^{10}$ is lower alkyl group, and n is 0 to 2.

As the modified polyvinyl alcohol to be used in the present invention, its modification degree should preferably be 35 mol % or less, preferably 0.05 to 20 mol %, more preferably 0.05 to 10 mol %. Also, as the modified polyvinyl alcohol to be used, its polymerization degree may be 100 to 10000, preferably 500 to 2000.

Further, the modified polyvinyl alcohol to be used should be a saponification degree of 80 mol % or higher, preferably 85 mol % or higher.

The silicon-containing water-soluble polymer forms a chemically bound product with various inorganic materials and therefore can form an ink-receiving layer which is much firmer as compared with the polyvinyl alcohol which has been generally used in the prior art, whereby it becomes possible to obtain both ink absorptivity and coated layer strength which could be effected with difficulty in the prior art.

As the polymeric emulsion, there by be included not only the polymeric emulsions in narrow sense of which dispersed phase and dispersing medium are both liquid, but also emulsions of synthetic polymers where the polymer in the dispersed phase should be properly considered as the solid at a temperature below the glass transition temperature as in the case of polystyrene emulsion.

Specific examples of the polymeric emulsion to be used in the present invention may include synthetic polymeric latices such as styrene-butadiene type latex, acrylonitrile-butadiene type latex, methyl methacrylate-butadiene type latex, vinyl acetate type latex, ethylene-vinyl acetate type latex, etc., as well as polyethylene emulsion, polystyrene emulsion, ionomer emulsion, etc.

In the related art, when a polymeric emulsion is used as the binder for a coated layer comprising a porous inorganic pigment as the main component, it had a drawback of low optical density of the image, although excellent in ink absorptivity. However, by simultaneously using a polymeric emulsion and particularly a silicon-containing water-soluble polymer as in the constitution of the recording medium of the present invention, it becomes possible to improve ink absorptivity, coated layer strength and optical density of image at the same time.

The recording medium of the present invention is prepared by adding a spherical silica and a binder into a coating solution for a substrate such as paper, etc., applying the coating solution on the substrate and drying the coated product. As other components contained in the coating solution in this case, there may be included organic pigments such as styrene type plastic pigments, acrylic type pigments, microcapsules, urea resin pigments, etc.; water-soluble polymers such as starch, gelatin, casein, gum arabic, sodium alginate, carboxymethyl cellulose, polyvinyl alcohol, polyvinylpyrrolidone, sodium polyacrylate, etc.; organic solvent soluble resins such as polyvinylbutyral, polyvinyl chloride, etc.; further various additives such as dispersing agents, fluorescent dyes, pH controllers, defoaming agents, lubricants, preservatives, surfactants, water resistant agents, etc.

Of the above components, water-soluble polymers, polymeric emulsions and organic solvent soluble resins used as the binders may be employed in an amount of 3 to 100 parts, preferably 10 parts to 80 parts based on 100 parts of spherical silica, but their amounts are not particularly limited if sufficient for binding spherical silica. However, use of more than 100 parts of the binder will undesirably make the void of the ink-receiving layer smaller.

The solid content in the coating solution should preferably an amount of about 1 to 50 wt. %, and said coating solution is applied by a method known in the art such as the roll coater method, the blade coater method, the air knife coater method, etc., to the substrate, generally in an amount of about 1 to 50 g/m$^2$ (dry coated amount), preferably, in an amount of about 2 to 30 g/m$^2$ (dry coated amount).

Such recording medium as has only the ink-receiving layer provided on the substrate, as it stands, can be used as the recording medium of the present invention, and it is also possible to give smoothness of the surface by super-calendering.

Next, the ink to be used in the recording method of the present invention is a recording liquid comprising a water-soluble dye and a liquid medium, together with other additives, the ink having a surface tension at 25° C. within the range of 28 to 68 dyn/cm, preferably 30 to 65 dyn/cm, more preferably 40 to 60 dyn/cm. When printing is performed by use of an ink having lower surface tension than this range, its wettability to the recording medium is good, but spreading of the printed dot becomes greater. On the other hand, when an ink having higher surface tension than the above range is used, its wettability to the recording medium becomes bad, whereby ink absorptivity of the recording medium and dot density will be undesirably lowered.

As the water-soluble dye (recording agent) which is the essential component of the ink to be used in the recording method of the present invention, water-soluble dyes such as direct dyes, acidic dyes or dyes for foods, etc., may be preferably used.

Such water-soluble dyes may be generally used as a solution dissolved in a liquid medium comprising water and an organic solvent, and as such liquid medium components, mixtures of water and various water-soluble organic solvents may be preferably used, with the water content in the ink being preferably controlled within the range of from 20 to 90 wt. %.

Examples of the above water-soluble organic solvents may include alkyl alcohols having 1 to 4 carbon atoms such as methyl alcohol, ethyl alcohol, n-propyl alcohol, isopropyl alcohol, n-butyl alcohol, sec-butyl alcohol, tert-butyl alcohol, isobutyl alcohol, etc.; amides such as dimethylformamide, dimethylacetamide, etc.; ketone or ketone alcohols such as acetone, diacetone alcohol, etc.; ethers such as tetrahydrofuran, dioxane, etc.; polyalkylene glycols such as polyethylene glycol, polypropylene glycol, etc.; alkylene glycols containing alkylene groups with 2 to 6 carbon atoms such as ethylene glycol, propylene glycol, 1,2,6-hexane triol, thioglycol, hexylene glycol, diethylene glycol, etc.; glycerine; lower alkyl ethers of polyhydric alcohols such as ethylene glycol methyl ether, diethylene glycol methyl (or ethyl) ether, triethylene glycol monomethyl (or ethyl) ether, etc. Of these many water-soluble organic solvents, polyhydric alcohols such as diethylene glycol, etc., lower alkyl ethers of polyhydric alcohol such as triethylene glycol monomethyl (or ethyl) ether, etc., are preferred. Polyhydric alcohols are particularly preferred, since they have the great effect as the wetting agent which prevents the phenomenon of clogging of nozzles caused by precipitation of the water-soluble dye through evaporation of water in the ink.

A solubilizing agent can be also added in the ink. Typical solubilizing agents are nitrogen-containing heterocyclic ketones, and their intended action is to improve dramatically the solubility of the water-soluble dye in the liquid medium. For example, N-methyl-2-pyrrolidone, 1,3-dimethyl-2-imidazolidinone may be preferably used.

The ink prepared from such components is itself excellent in recording characteristics (signal response, stability of liquid droplet formation, discharging stability, continuous recording performance over a long time, discharging stability after recording stopping over a long time), storage stability, fixability onto a recording medium, and various additives may be further added thereto for improvement of these characteristics. For example, there may be employed viscosity controllers of water-soluble resins, etc., such as polyvinyl alcohol, celluloses, etc.; various surfactants such as cationic, anionic or nonionic surfactants; surface tension controllers such as diethanolamine, triethanolamine, etc.; pH controllers with buffer solutions, etc.

Also, for formulation of an ink to be used for the ink jet recording method of the type in which ink is charged, specific resistance controllers of inorganic salts such as lithium chloride, ammonium chloride, sodium chloride, etc., may be added. Further, when ink is applied for the ink jet recording system of the type in which ink is discharged by the action of heat energy, thermal physical properties (e.g. specific heat, coefficient of thermal expansion, thermal conductivity, etc.) may be sometimes controlled.

In the present invention, it can be considered, as mentioned below, how color forming characteristics of image, optical density and dot shape can be improved.

That is, in the case of a recording paper with little content of loading material or small ink absorbing capacity of loading materials, the ink collided with the paper surface is blurred along the fibers to disturb the dot shapes, and at the same time the dye is penetrated deep into the inner portion of the paper, whereby the optical density of image will be lowered.

On the other hand, since the recording medium of the present invention contains spherical silica with appropriate particle diameters in the surface layer and in the inside of the medium (in large amount), the probability of the ink droplets being captured and absorbed by the spherical silica is high, whereby blurring and diffusion of the ink may be considered to be inhibited to improve the dot shapes. Further, in the case of spherical silica, since uniformity in shape and size of the voids between the secondary particles is high, the improvement effect of the dot shape may be considered to become greater as compared with the case of amorphous silica.

Also, in the recording medium of the present invention containing spherical silica, since the ink absorbing capacity of the spherical silica is high, the ink remains near the surface of the printed surface, and further capillary condensation of the dye is liable to occur near the surface layer of the secondary particles, the silica having fine pore sizes with small scattering coefficient, whereby excellent color forming characteristic and optical density may be considered to be exhibited.

In the present invention, it may be considered as follows how ink absorptivity and coated layer strength can be improved while maintaining excellent color forming characteristic of the image by using particularly a silicon-containing water-soluble polymer as the binder in the receiving layer.

That is, when a water-soluble polymer is used as a binder for spherical silica, the amount of the water-soluble polymer must be increased in order to impart sufficient coated layer strength, whereby the interparticulate voids between and the inner surface area of the pigment particles become smaller and ink absorptivity is liable to be lowered.

On the other hand, the silicon-containing water-soluble polymer to be used in the present invention forms a chemically bound product with spherical silica to have a strong binding force, and therefore the amount of the silicon-containing water-soluble polymer formulated for imparting sufficient coated layer strength may be smaller as compared with the case of a water-soluble polymer of the related art. Accordingly, in the particular case fusing the silicon-containing water-soluble polymer, it becomes possible to obtain both of good ink absorptivity and coated layer strength.

Also, when a polymeric emulsion is used alone in a small amount as the binder for the porous inorganic pigment, a recording medium having sufficient coated layer strength and excellent ink absorptivity can be obtained, but due to small affinity between the water-soluble dye and the binder, there is the drawback that optical density of the image is low.

Accordingly, by using as the binder a silicon-containing water-soluble polymer and a polymeric emulsion in combination, it becomes possible to improve ink absorptivity and coated layer strength at the same time while maintaining more excellent optical density of the image.

According to the present invention, ink can be absorbed rapidly into the inner portion of the recording medium, without the phenomenon of flow-out or blurring of the ink even when inks with different colors may be attached on the same site within short time, to give a recorded image of high resolution with excellent color forming characteristic. Also, because of strong coated layer strength, powder drop-off will occur with difficulty, whereby the problems such as clogging of nozzle, etc., will hardly occur. According, the recording medium of the present invention is suitable not only for recording in general, but also particularly for ink jet recording method. Above all, when the surface tension of the recording liquid is from 40 to 60 dyn/cm, excellent effect can be obtained which can satisfy color characteristic, optical density, ink absorptivity at the same time.

The present invention is described in more detail by referring to the following Examples and Comparative examples, by which the present invention is not limited. In the description, parts or % are based on weight, unless otherwise particularly noted.

EXAMPLES 1–5, COMPARATIVE EXAMPLES 1–3

As the starting material pulps, 80 parts of LBKP with a freeness (C.S.F.) of 370 ml and 20 parts of NBKP with a freeness of 410 ml were employed, and a synthetic spherical silica was internally added as the loading material in an amount of 35 wt. % based on the pulp solid content, and a cationized starch (CATOF, produced by Oji National) as the yield enhancer in an amount of 0.3 wt. % based similarly on the pulp solid, and further a polyacrylamide type yield enhancer (Pearlfrock FR-X, produced by Seiko Kagaku Kogyo) was added in an amount of 0.05 wt. % immediately before paper-making, followed by paper-making at a basis weight of 70 $9/m^2$ by use of a TAPPI standard sheet former.

Then, an oxidized starch (MS3800, produced by Nippon Shokuhin) solution with a concentration of 2% was attached by a size press device to give recording media of the present invention and for comparative purpose.

The synthetic spherical silicas employed were as shown below.

EXAMPLE 1

Hipersil-3 (trade name, produced by Shandon Co.; average diameter, 3.2 μm; fine pore size, 120 Å; proportion of the particles in the particle size range of average diameter ±1.5 μm, 97%)

EXAMPLE 2

Wakogel LC-10K (trade name; produced by Wako Junyaku Kogyo; average diameter, 10 μm, fine pore size, 90 Å)

EXAMPLE 3

Hipersil-5 (trade name; produced by Shandon Co.; average diameter, 5 μm; fine pore size, 120 Å; proportion of the particles in the particle size range of average diameter ±1.5 μm, 94%)

EXAMPLE 4

TSK gel silica 60 (trade name; produced by Toyo Soda Kogyo; average diameter, 5 μm; fine pore size, 60 Å)

EXAMPLE 5

Unisil Q30 (trade name; produced by Gaskuro Kogyo; average diameter, 10 μm; fine pore size, 35 Å).

For comparative purpose, the above spherical silicas were replaced with the loading materials shown below to give Comparative examples.

COMPARATIVE EXAMPLE 1

Synthetic amorphous silica (Syloid 72, produced by Fuji Devison Kagaku; average diameter, 4.3 μm; fine pore size, 170 Å)

COMPARATIVE EXAMPLE 2

Heavy calcium carbonate (Escaron #200, produced by Sankyo Seifun)

COMPARATIVE EXAMPLE 3

Talc (LM-S1, produced by Fuji Talc Kogyo; average diameter, 2.3 μm).

For the above recording media ink jet recording was performed by an ink jet printer (produced by Canon, PJ-1080), and ink jet recording aptitude was evaluated.

(1) Dot size

Diameters of 20 printed dots were measured by a stereoscopic microscope, and shown as an average value.

(2) Dot shape

Printed dot was observed by a stereoscopic microscope, and a shape which is substantially circular is rated as o, a shape which is slightly deformed in circular diameter as Δ, and an amorphous shape as x.

(3) Color forming characteristic

Sharpness of the color of the ink jet recorded image was compared by visual observation, and evaluated at the ranks of ◎ ○Δ, x with the best one being ◎ and the worst one x.

(4) Optical density

The solid printed portion was measured by a Macbeth densitometer TR-534 model.

The results are shown in Table 1.

| (Ink composition) | |
|---|---|
| C.I. Direct Blue 86 | 3 parts |
| Diethylene glycol | 30 parts |
| N—methyl-2-pyrrolidone | 10 parts |
| Pure water | 60 parts |
| (Surface tension at 25° C. 54 dyn/cm) | |

TABLE 1

| | Item | | | |
|---|---|---|---|---|
| | Dot diameter (μm) | Dot shape | Color forming characteristic | Optical density (O.D.) |
| Recording paper: | | | | |

TABLE 1-continued

| | Item | | | |
|---|---|---|---|---|
| | Dot diameter (μm) | Dot shape | Color forming characteristic | Optical density (O.D.) |
| Example 1 | 385 | ○ | ◎ | 0.68 |
| Example 2 | 392 | ○ | ◎ | 0.71 |
| Example 3 | 390 | ○ | ◎ | 0.70 |
| Example 4 | 388 | ○ | ◎ | 0.71 |
| Example 5 | 394 | ○ | ◎ | 0.72 |
| Comparative example 1 | 403 | Δ | ○ | 0.59 |
| Comparative example 2 | 442 | x | x | 0.56 |
| Comparative example 3 | 418 | x | Δ | 0.52 |

EXAMPLE 6

By use of LBKP with a freeness (C.S.F.) of 400 ml, talc (LM-S1, produced by Fuji Talc Kogyo) was added internally thereto as the loading material in an amount of 20 wt. % based on the pulp solid content, and a cationized starch (CATOF, produced Oji National) as the yield enhancer in an amount of 0.2 wt. % based similarly on the pulp solid, followed by paper-making at a basis weight of 70 g/m$^2$ by use of a TAPPI standard sheet former to provide an original paper.

Then, the above paper was subjected to impregnating coating treatment with a solution having the following composition by means of a size press device to a dried coating amount of 4.0 g/m$^2$, followed by drying in a conventional manner, to obtain the recording paper of the present invention.

| | |
|---|---|
| Polyvinyl alcohol (PVA105; produced by Kuraray) | 4 parts |
| Synthetic spherical silica (Deverosil 100-3; produced by Nomura Kagaku; average diameter, 3.3 μm; the proportion of particles within the particle size range of average diameter ±1.5 μm, 80%) | 4 parts |
| Water | 92 parts |

On the above recording medium, ink jet recording was performed with the use of the ink shown below, and the ink jet recording characteristics were evaluated similarly as in Examples 1 to 5. The results are shown in Table 2.

| | (Composition) |
|---|---|
| Ink A: surface tension 68 dyn/cm | |
| Glycerine | 10 parts |
| Pure water | 90 parts |
| C.I. Acid Red 87 | 2 parts |
| Ink B: surface tension 64 dyn/cm | |
| Diethylene glycol | 5 parts |
| Glycerine | 10 parts |
| Pure water | 85 parts |
| C.I. Acid Red 87 | 2 parts |
| Ink C: surface tension 58 dyn/cm | |
| Diethylene glycol | 30 parts |
| Pure water | 70 parts |
| C.I. Acid Red 87 | 2 parts |
| Ink D: surface tension 44 dyn/cm | |
| Ethylene glycol | 15 parts |
| Diethylene glycol | 15 parts |
| Pure water | 70 parts |
| Acetynol EH | 0.2 parts |
| C.I. Acid Red 87 | 2 parts |

-continued

| | (Composition) |
|---|---|
| Ink E: surface tension 33 dyn/cm | |
| Ethylene glycol | 15 parts |
| Diethylene glycol | 15 parts |
| Pure water | 70 parts |
| Acetynol EH | 0.7 parts |
| C.I. Acid Red 87 | 2 parts |
| Ink F: surface tension 28 dyn/cm | |
| Ethylcellosolve | 10 parts |
| Diethylene glycol | 10 parts |
| Ethylene glycol | 10 parts |
| Pure water | 60 parts |
| Florade FC430 | 1.5 parts |
| C.I. Acid Red 87 | 2 parts |

TABLE 2

| | Ink | | | | | |
|---|---|---|---|---|---|---|
| | A | B | C | D | E | F |
| Surface tension: | 68 | 64 | 58 | 44 | 33 | 28 |
| Evaluation Item: | | | | | | |
| Dot diameter (μm) | 321 | 337 | 363 | 378 | 395 | 401 |
| Dot shape | Δ | ○ | ○ | ○ | ○ | Δ |
| Color forming characteristic | Δ | ○ | ◎ | ◎ | ○ | ○ |
| Optical density | 0.51 | 0.69 | 0.76 | 0.74 | 0.67 | 0.60 |

EXAMPLE 7

On the recording media of the present invention obtained in Examples 1–6, by use of the four kinds of inks as shown below, an ink jet recording was practiced by use of a recording device having on-demand type ink jet recording head (orifice size 50×40 μm; the number of nozzle, 24; driving voltage, 24.5 V; frequency 2 KHz) in which bubbles are generated by a heat generating resistor and ink is discharged by the pressure of the bubbles.

| | |
|---|---|
| Yellow ink | |
| C.I. Direct yellow 86 | 2 parts |
| N—methyl-2-pyrrolidone | 10 parts |
| Diethylene glycol | 20 parts |
| Polyethylene glycol #200 | 15 parts |
| Water | 55 parts |
| Magenta ink | |
| C.I. Acid Red 35 | 2 parts |
| N—methyl-2-pyrrolidone | 10 parts |
| Diethylene glycol | 20 parts |
| Polyethylene glycol #200 | 15 parts |
| Water | 55 parts |
| Cyan ink | |
| C.I. Direct Blue 86 | 2 parts |
| N—methyl-2-pyrrolidone | 10 parts |
| Diethylene glycol | 20 parts |
| Polyethylene glycol #200 | 15 parts |
| Water | 55 parts |
| Black ink | |
| C.I. Food Black 2 | 2 parts |
| N—methyl-2-pyrrolidone | 10 parts |
| Diethylene glycol | 20 parts |
| Polyethylene glycol #200 | 15 parts |
| Water | 55 parts |

As a result, in every recording medium, sharp color images with excellent color forming characteristic and high optical density were obtained.

EXAMPLES 8–11, COMPARATIVE EXAMPLES 4,5

As the substrate, a general fine paper with the size degree of 35 sec. based on JISP8122 (Ginwa (trade name); basis weight 64 g/m$^2$; produced by Sanyo Kokusaku K.K.) was used and a coating solution having a composition shown below was coated on the substrate at a dried coating amount of 15 g/m$^2$ by a blade coater, followed by drying in a conventional manner, to obtain the recording medium to be used in the present invention.

| | |
|---|---|
| Synthetic spherical silica | 100 parts |
| Polyvinyl alcohol (PVA117; produced by Kuraray) | 50 parts |
| Water | 380 parts |

The synthetic spherical silica employed are shown below.

(EXAMPLE 8)

Hipersil-3 (as described above)

(EXAMPLE 9)

Hipersil-5 (as described above)

(EXAMPLE 10)

Hipersil-10 (trade name; produced by Shandon Co.; average diameter, 9.8 μm; proportion of the particles within the particle size range of average diameter ±1.5 μm, 84%)

(EXAMPLE 11)

Deverosil 100-3 (as described above) Also, for comparative purpose, the above spherical silica was replaced with the wet process synthetic amorphous silica shown below to give Comparative examples.

(COMPARATIVE EXAMPLE 4)

Nipsil E200A (trade name; produced by Nippon silica Kogyo K.K.; average diameter, 1.5 μm; proportion of the particles within the particle size range of average diameter ±1.5 μm, 99%)

(COMPARATIVE EXAMPLE 5)

Nipsil E150K (trade name; produced by Nippon Silica Kogyo K.K.; average diameter, 4.6 μm; proportion of the particles within the particle size range of average diameter ±1.5 μm, 8%).

On the above recording media, ink jet recording was performed by an ink jet printer (PJ-1080; produced by Canon), and the ink jet recording aptitude was evaluated.

Evaluation was conducted for optical density (O.D.), color forming characteristic, dot diameter, ink absorptivity, coated layer strength.

The ink absorptivity is represented by the amount of ink absorbed within one second after solid printing of cyan. Ink absorptivity is better, as the numerical value is greater.

The coated layer strength was measured by writing on the ink receiving layer surface of the recording medium with three pencils of 2 H, H, HB, and the medium which gave powder drop-off with the use of any pencil was rated as x, the medium which gave no powder drop-off with the use of any pencil ◎, and the medium which gave no powder drop-off with the use of HB pencil but which gave powder drop-off with H and 2 H pencils, respectively, as ○.

The results are shown in Table 3.

| (Ink composition) | |
|---|---|
| C.I. Direct Blue 86 | 3 parts |
| Diethylene glycol | 30 parts |
| N—methyl-2-pyrrolidone | 10 parts |
| Pure water | 60 parts |
| (Surface tension at 25 ° C. 54 dyn/cm) | |

COMPARATIVE EXAMPLE 6

A recording medium of Comparative example 6 was prepared in entirely the same manner as in Comparative example 5 except for changing the amount of the polyvinyl alcohol formulated to 70 parts, and its ink jet recording aptitude was evaluated. The results are shown in Table 3.

TABLE 3

| | Item | | | | |
|---|---|---|---|---|---|
| | Optical density (O.D.) | Color forming characteristic | Dot diameter (μm) | Ink absorptivity cc/cm² | Coated layer strength |
| Recording medium: | | | | | |
| Example 8 | 1.40 | ◎ | 235 | $2.92 \times 10^{-3}$ | ○ |
| Example 9 | 1.35 | ◎ | 218 | $3.74 \times 10^{-3}$ | ○ |
| Example 10 | 1.18 | ○ | 224 | $3.45 \times 10^{-3}$ | ○ |
| Example 11 | 1.33 | ◎ | 230 | $2.88 \times 10^{-3}$ | ○ |
| Comparative example 4 | 1.25 | ◎ | 232 | $2.84 \times 10^{-3}$ | × |
| Comparative example 5 | 1.02 | ○ | 220 | $3.10 \times 10^{-3}$ | × |
| Comparative example 6 | 1.36 | ○ | 252 | $2.30 \times 10^{-3}$ | ○ |

EXAMPLE 12

As the substrate, a general fine paper (Ginwa: trade name, basis weight 64 g/m²) was used and a coating solution having a composition shown below was coated on the substrate at a proportion of dried coating amount of 12 g/m² by an air knife coater, followed by drying in a conventional manner, to obtain a recording medium.

| | |
|---|---|
| Spherical silica (Hipersil-5) | 100 parts |
| Polyvinyl alcohol (PVA117; produced by Kuraray) | 20 parts |
| Polyvinyl alcohol (PVA105; produced by Kuraray) | 40 parts |
| Cationic resin (Polyfix601; produced by Showa Kobunshi) | 5 parts |
| Water | 750 parts |

On the recording medium, ink jet recording was performed similarly as in Example 6 and its recording characteristics were evaluated. The results are shown in Table 4.

TABLE 4

| | Ink | | | | | |
|---|---|---|---|---|---|---|
| | A | B | C | D | E | F |
| Surface tension: | 68 | 64 | 58 | 44 | 33 | 28 |
| Evaluation item: | | | | | | |
| Dot diameter (μm) | 280 | 310 | 342 | 360 | 366 | 381 |
| Dot shape | Δ | ○ | ○ | ○ | ○ | Δ |
| Color forming characteristic | Δ | ○ | ◎ | ◎ | ◎ | ○ |
| Optical density (O.D.) | 0.76 | 0.87 | 0.92 | 0.89 | 0.82 | 0.69 |
| Ink absorptivity cc/cm² | $0.86 \times 10^{-3}$ | $1.15 \times 10^{-3}$ | $2.01 \times 10^{-3}$ | $2.15 \times 10^{-3}$ | $2.30 \times 10^{-3}$ | $2.88 \times 10^{-3}$ |

EXAMPLES 13–17

As the substrate, a general fine paper with the size degree of 35 sec. based on JISP8122 (Ginwa; trade name; basis weight 64 g/m²; produced by Sanyo Kokusaku Pulp K.K) was used and a coating solution having a composition shown below was coated on the substrate at a dried coating amount of 15 g/m² by a bar coater, followed by drying in a conventional manner, to obtain the recording medium to be used in the present invention.

EXAMPLE 13

| | |
|---|---|
| Spherical silica (Wakogel LC-10K, as described above) | 100 parts |
| Silicon-containing water-soluble polymer (R-2105; produced by Kuraray K.K) | 40 parts |
| Cationic resin (Polyfix601; produced by Showa Kobunshi K.K.) | 5 parts |
| Water | 660 parts |

EXAMPLE 14

| | |
|---|---|
| Spherical silica (Hipersil-3, as described above) | 100 parts |
| Silicon-containing water-soluble polymer (R-1130; produced by Kuraray K.K.) | 40 parts |
| Cationic resin (Polyfix601; produced by Showa Kobunshi K.K.) | 5 parts |
| Water | 660 parts |

EXAMPLE 15

| | |
|---|---|
| Spherical silica (UnisilQ30, as described above) | 100 parts |
| Silicon-containing water-soluble polymer (R-2130; produced by Kuraray K.K.) | 40 parts |
| Cationic resin (Polyfix601; produced by Showa Kobunshi K.K.) | 5 parts |
| Water | 660 parts |

EXAMPLE 16

| | |
|---|---|
| Spherical silica (UnisilQ30, as described above) | 100 parts |
| Silicon-containing water-soluble polymer (R-1130; produced by Kuraray K.K.) | 20 parts |
| Styrene-butadiene type latex (L-1876; produced by Asahi Kasei K.K.) | 20 parts |
| Cationic resin (Polyfix601; produced by Showa Kobunshi K.K.) | 5 parts |
| Water | 660 parts |

EXAMPLE 17

| | |
|---|---|
| Spherical silica (Hipersil-5, as described above) | 100 parts |
| Ethylene-acetic acid vinyl type latex | 20 parts |
| Silicon-containing water-soluble polymer (R-1130; produced by kuraray K.K.) | 20 parts |
| Cationic resin (Polyfix601; produced by Showa Kobunshi K.K.) | 5 parts |
| Water | 660 parts |

On the recording media obtained, ink jet recording was performed by use of an ink jet printer (PJ-1080; produced by Canon) and ink jet recording aptitude was evaluated. The results are shown in Table 5.

Evaluation was conducted in the same manner as the above Examples.

TABLE 5

| | Item | | | | |
|---|---|---|---|---|---|
| | Optical density (O.D.) | Color forming characteristic | Dot diameter (μm) | Ink adsorptivity cc/cm$^2$ | Coated layer strength |
| Recording medium: | | | | | |
| Example 13 | 1.22 | ◎ | 228 | $3.23 \times 10^{-3}$ | ◎ |
| Example 14 | 1.28 | ◎ | 233 | $3.18 \times 10^{-3}$ | ◎ |
| Example 15 | 1.27 | ◎ | 222 | $3.22 \times 10^{-3}$ | ◎ |
| Example 16 | 1.34 | ◎ | 220 | $3.45 \times 10^{-3}$ | ◎ |
| Example 17 | 1.39 | ◎ | 229 | $3.48 \times 10^{-3}$ | ◎ |

What we claim is:

1. A recording medium comprising a substrate and an ink receiving layer provided on said substrate, wherein the ink receiving layer contains spherical silica and a silicon-containing water-soluble polymer.

2. A recording medium according to claim 1, wherein the secondary particle size of the spherical silica has an average diameter in the range of from 0.5 to 150 μm.

3. A recording medium according to claim 1, wherein the ratio of the shortest diameter to the longest diameter of the spherical silica is 0.6 or more.

4. A recording medium according to claim 1, wherein the secondary particles of the spherical silica has a fine pore size of 30 to 400 Å.

5. A recording medium according to claim 1, wherein the ink receiving layer contains a polymeric emulsion.

6. A recording medium according to claim 1, wherein the silicon-containing water-soluble polymer is a silicon-containing modified polyvinyl alcohol.

7. A recording medium according to claim 6, wherein the silicon-containing modified polyvinyl alcohol is a copolymerization product of a vinyl ester and a monomer selected from the group consisting of $$CH_2=CH(CH_2)_nSi(R'_m)(R^2)_{3-m}$$

wherein n is 0 or 1, m is 0 to 2, R′ is lower alkyl, allyl or lower alkyl with an allyl group and $R^2$ is saturated $C_{1-40}$ branched or non-branched alkoxyl which may have an oxygen-containing substituent;

$$CH_2=C(R^3)CON(R^4)R^5Si(R_n^6)(R^7)_{3-n}$$

wherein $R^3$ is H or methyl, $R^4$ is H or lower alkyl, $R^5$ is alkylene or a divalent organic residue having a carbon chaim mutually bonded with oxygen or nitrogen, $R^6$ is H, halogen, lower alkyl, allyl or lower alkyl with an allyl group, $R^7$ is alkoxyl or acyloxyl, both of which may have an oxygen or nitrogen-containing substituent and n is 0 to 2; and $$CH_2=C(R^8)Si(R_n^9)(OC(O)R^{10})_{3-n}$$

wherein $R^8$ is H or methyl, $R^9$ is H, halogen, lower alkyl, allyl or lower alkyl with an allyl group, $R^{10}$ is lower alkyl and n is 0 to 2.

8. A recording medium comprising a substrate and an ink receiving layer provided on said substrate, wherein spherical silica having an average diameter of 3.2 to 10 μm are coated onto the substrate with a silicon-containing water-soluble polymer at a ratio of 100 parts silica to 3–100 parts polymer.

9. A recording medium according to claim 8, wherein the secondary particles of the spherical silica have an average fine pore size in the range of from 30 to 400 Å.

10. A recording medium according to claim 8, wherein the ratio of the shortest diameter to the longest diameter of the spherical silica is 0.6 or more.

11. A recording medium according to claim 8, wherein the silicon-containing water-soluble polymer is a silicon-containing modified polyvinyl alcohol.

12. A recording medium according to claim 11, wherein the silicon-containing modified polyvinyl alcohol is a copolymerization product of a vinyl ester and a monomer selected from the group consisting of $$CH_2=CH(CH_2)_nSi(R'_m)(R^2)_{3-m}$$

wherein n is 0 or 1, m is 0 to 2, R′ is lower alkyl, allyl or lower alkyl with an allyl group and $R^2$ is saturated $C_{1-40}$ branched or non-branched alkoxyl which may have an oxygen-containing substituent;

$$CH_2=C(R^3)CON(R^4)R^5Si(R_n^6)(R^7)_{3-n}$$

wherein $R^3$ is H or methyl, $R^4$ is H or lower alkyl, $R^5$ is alkylene or a divalent organic residue having a carbon chain mutually bonded with oxygen or nitrogen, $R^6$ is H, halogen, lower alkyl, allyl or lower alkyl with an allyl group, $R^7$ is alkoxyl or acyloxyl, both of which may have an oxygen or nitrogen-containing substituent and n is 0 to 2; and $$CH_2=C(R^8)Si(R_n^9)(OC(O)R^{10})_{3-n}$$

wherein $R^8$ is H or methyl, $R^9$ is H, halogen, lower alkyl, allyl or lower alkyl with an allyl group, $R^{10}$ is lower alkyl and n is 0 to 2.

13. A recording medium comprising a substrate and an ink receiving layer provided on said substrate wherein spherical silica having an average diameter of 3.2 to 10 μm are coated onto the substrate with a silicon-containing water-soluble polymer at a ratio of 100 parts silica to 3–100 parts polymer, and wherein the particle proportion within the particle size range of average diameter ±1.5 μm is 60% or more.

14. A recording medium according to claim 13, wherein said particle proportion is 80% or more.

15. A recording medium according to claim 13, wherein the ratio of the shortest diameter to the longest diameter of the spherical silica is 0.6 or more.

16. A recording medium according to claim 13, wherein the secondary particles of the spherical silica have a fine pore size of 30 to 400 A.

17. A recording medium according to claim 13, wherein the silicon-containing water-soluble polymer is a silicon-containing modified polyvinyl alcohol.

18. A recording medium according to Claim 17, wherein the silicon-containing modified polyvinyl alcohol is a copolymerization product of a vinyl ester and a monomer selected from the group consisting of $$CH_2=CH(CH_2)_nSi(R'_m)(R^2)_{3-m}$$

wherein n is 0 or 1, m is 0 to 2, R′ is lower alkyl, allyl or lower alkyl with an allyl group and $R^2$ is saturated $C_{1-40}$ branched or non-branched alkoxyl which may have an oxygen-containing substituent;

$$CH_2=C(R^3)CON(R^4)R^5Si(R_n^6)(R^7)_{3-n}$$

wherein $R^3$ is H or methyl, $R^4$ is H or lower alkyl, $R^5$ is alkylene or a divalent organic residue having a carbon chain mutually bonded with oxygen or nitrogen, $R^6$ is H, halogen, lower alkyl, allyl or lower alkyl with an allyl group, $R^7$ is alkoxyl or acyloxyl, both of which have an oxygen or nitrogen-containing substituent and n is 0 to 2; and $$CH_2=C(R^8)Si(R_n^9)(OC(O)R^{10})_{3-n}$$

wherein $R^8$ is H or methyl, $R^9$ is H, halogen, lower alkyl, allyl or lower alkyl with an allyl group, $R^{10}$ is lower alkyl and n is 0 to 2.

* * * * *

UNITED STATES PATENT AND TRADEMARK OFFICE

CERTIFICATE OF CORRECTION

PATENT NO. : 4,902,568 Page 1 of 3

DATED : February 20, 1990

INVENTOR(S) : Naoya Morohoshi

It is certified that error appears in the above-identified patent and that said Letters Patent is hereby corrected as shown below:

COLUMN 1:

Line 37, "use" should read --uses--.

Line 49, "high," should read --high--.

COLUMN 3:

Line 39, "diatomeceous" should read --diatomaceous--.

COLUMN 4:

Line 61, "undesirably" should read --undesirable--.

Line 64, "that" should read --in that--.

COLUMN 5:

Line 4, "Åis" should read --Å is--.

COLUMN 6:

Line 41, "radial" should read --radical--.

UNITED STATES PATENT AND TRADEMARK OFFICE

CERTIFICATE OF CORRECTION

PATENT NO. : 4,902,568 Page 2 of 3

DATED : February 20, 1990

INVENTOR(S) : Naoya Morohoshi

It is certified that error appears in the above-identified patent and that said Letters Patent is hereby corrected as shown below:

COLUMN 7:

Line 3, "by" should read --may--.

Line 55, "erably an" should read --erably be an--.

COLUMN 10:

Line 51, "$9/m^2$" should read --$g/m^2$--.

COLUMN 14:

Line 68, "pencil ⊙," should read --pencil as ⊙,--.

COLUMN 17:

Line 35, "kuraray K.K.)" should read --Kuraray K.K.)--.

Line 61, "What we claim is:" should read --What I claim is:--.

UNITED STATES PATENT AND TRADEMARK OFFICE

CERTIFICATE OF CORRECTION

PATENT NO. : 4,902,568 Page 3 of 3

DATED : February 20, 1990

INVENTOR(S) : Naoya Morohoshi

It is certified that error appears in the above-identified patent and that said Letters Patent is hereby corrected as shown below:

COLUMN 18:

Line 5, "has" should read --have--

Line 28, chaim" should read --chain--

COLUMN 19:

Line 30, "400 A." should read --400 Å--.

Signed and Sealed this

Twenty-second Day of September, 1992

*Attest:*

DOUGLAS B. COMER

*Attesting Officer*

*Acting Commissioner of Patents and Trademarks*